US005367278A

United States Patent [19]

Yoshikawa

[11] Patent Number: 5,367,278

[45] Date of Patent: Nov. 22, 1994

[54] MAGNET HOLDING STRUCTURE

[75] Inventor: Toshimichi Yoshikawa, Nara, Japan

[73] Assignee: Kabushiki Kaisha Yoshikawakun Kogyosho, Nara, Japan

[21] Appl. No.: 72,080

[22] Filed: Jun. 7, 1993

[30] Foreign Application Priority Data

Sep. 19, 1992 [JP] Japan ..... 4-275384

[51] Int. Cl.[5] ..... H01F 7/20; H01F 7/02; A41H 31/00; A45F 5/00

[52] U.S. Cl. ..... 335/285; 335/302; 335/303; 223/109 A; 224/183; 206/818

[58] Field of Search ..... 335/285, 302, 306, 303; 223/109 A; 224/183; 206/818, 350; 51/362; 24/303; 269/8; 279/128; 7/901

[56] References Cited

U.S. PATENT DOCUMENTS 3,837,525 9/1974 Kobayashi ..... 220/55 K
4,484,682 11/1984 Crow ..... 206/545

*Primary Examiner*—Leo P. Picard
*Assistant Examiner*—Stephen T. Ryan
*Attorney, Agent, or Firm*—Lockwood Alex Fitzgibbon & Cummings

[57] ABSTRACT

A magnet holding structure comprising a magnet holder for holding a permanent magnet and a mounting frame formed integrally with a container such as a plastic basket for holding the magnet holder, the mounting frame including at least one pair of projecting walls having an engaging pawl on each of opposed inner surfaces thereof and the magnet holder having engaging projections corresponding to the engaging pawls, the interval of the engaging projections being slightly larger than the interval of the engaging pawls.

7 Claims, 5 Drawing Sheets

MAGNET HOLDING STRUCTURE

BACKGROUND OF THE INVENTION

1. Field of the Invention

The present invention relates to a magnet holding structure which finds application in attaching a basket or other container for holding a variety of things to a wall, steel appliance or other surface by utilizing the force of attraction of a permanent magnet.

2. Description of the Related Art

For attaching a container such as a plastic basket or utility holder to the surface of a steel appliance such as a laundering machine, a desk side or the like surface, several devices are available but in consideration of the ease of attaching and detaching, a permanent magnet is broadly employed.

The commonest method of using a permanent magnet for this purpose comprises bonding the magnet to a container such as a plastic basket or the like and the container so equipped with the magnet is attached to the laundering machine, desk side or he like by utilizing the force of attraction of the magnet.

However, since the method of attaching a magnet to a container in this manner involves the use of a double-sided adhesive tape, this method not only requires an additional material cost but entails the trouble of peeling off a release paper from the tape and attaching the adhesive surface of the tape to the container, thus calling for time and labor.

Furthermore, in a highly humid environment of use, for example when a basket is attached to a laundering machine, the ambient moisture penetrates into the double-sided tape to favor peeling of the tape so that the basket may fall spontaneously at times.

Furthermore, in order to ensure recycling of wastes, it is recently mandatory to sort the wastes by types of material but when a powerful double-sided adhesive tape is employed, the magnet can hardly be separated from the basket or the like so that the above recycling requirement cannot be easily met.

The present invention has been made to overcome the above-mentioned disadvantages. The object of the invention is, therefore, to provide a magnet holding structure which provides for the ease of mounting and dismounting a container carrying a permanent magnet with respect to a wall or other surface and insures a reduced incidence of spontaneous detachment even in a humid environment.

SUMMARY OF THE INVENTION

The magnet holding structure of the present invention for accomplishing the above-mentioned object comprises a magnet holder means for retaining a permanent magnet and a mounting frame means for accepting said magnet holder as formed integrally with a plastic vessel or the like, which mounting frame includes at least a pair of projecting walls, the mutually opposed surfaces of which are provided with engaging pawls, and said magnet holder means being formed with engaging projections corresponding to said engaging pawls of said projecting walls with the engaging projections being positioned such that when the magnet holder means is pressed into the mounting frame means said projections and said corresponding engaging pawls engage together in an interference fit such that the magnet holder means is retained securely by the mounting frame means.

DETAILED DESCRIPTION OF THE PREFERRED EMBODIMENTS

The preferred embodiments of the invention are now described with reference to the accompanying drawings.

Figure 1:
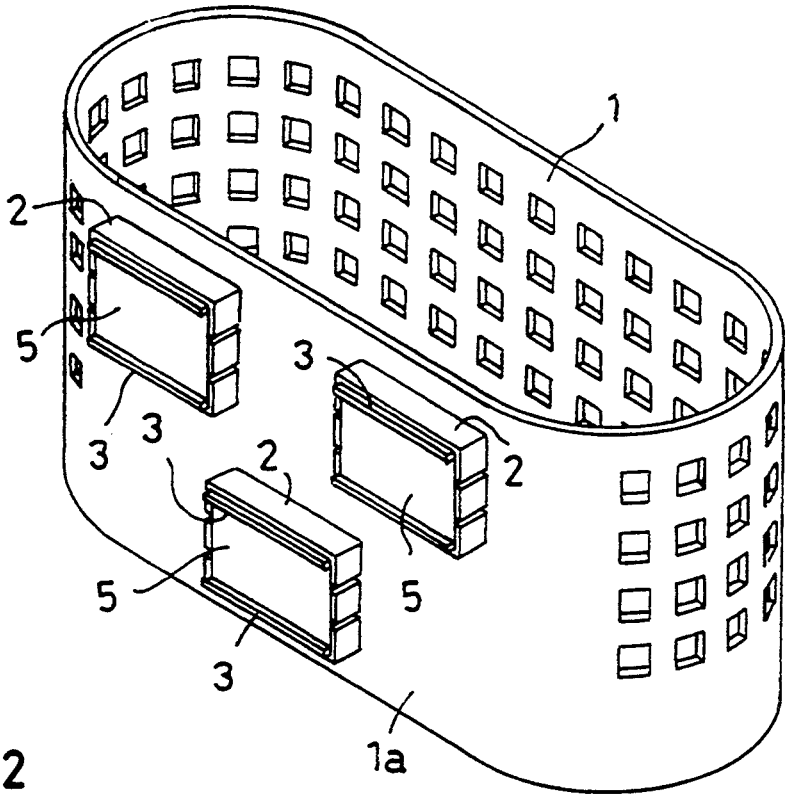
FIG. 1 is a perspective view of a container provided with the magnet holding structure according to an embodiment of the invention.
Figure 2:
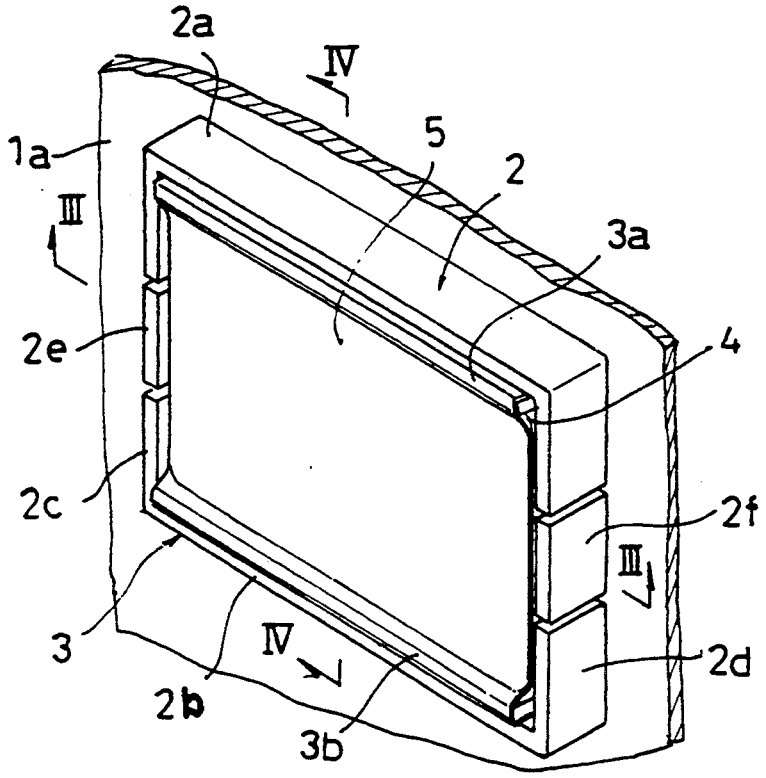
FIG. 2 is perspective view showing the magnet mounting structure.

FIG. 1 is a perspective view of a container provided with a magnet holding structure according to the invention and FIG. 2 is a perspective view showing the magnet holding structure.

Figure 7:
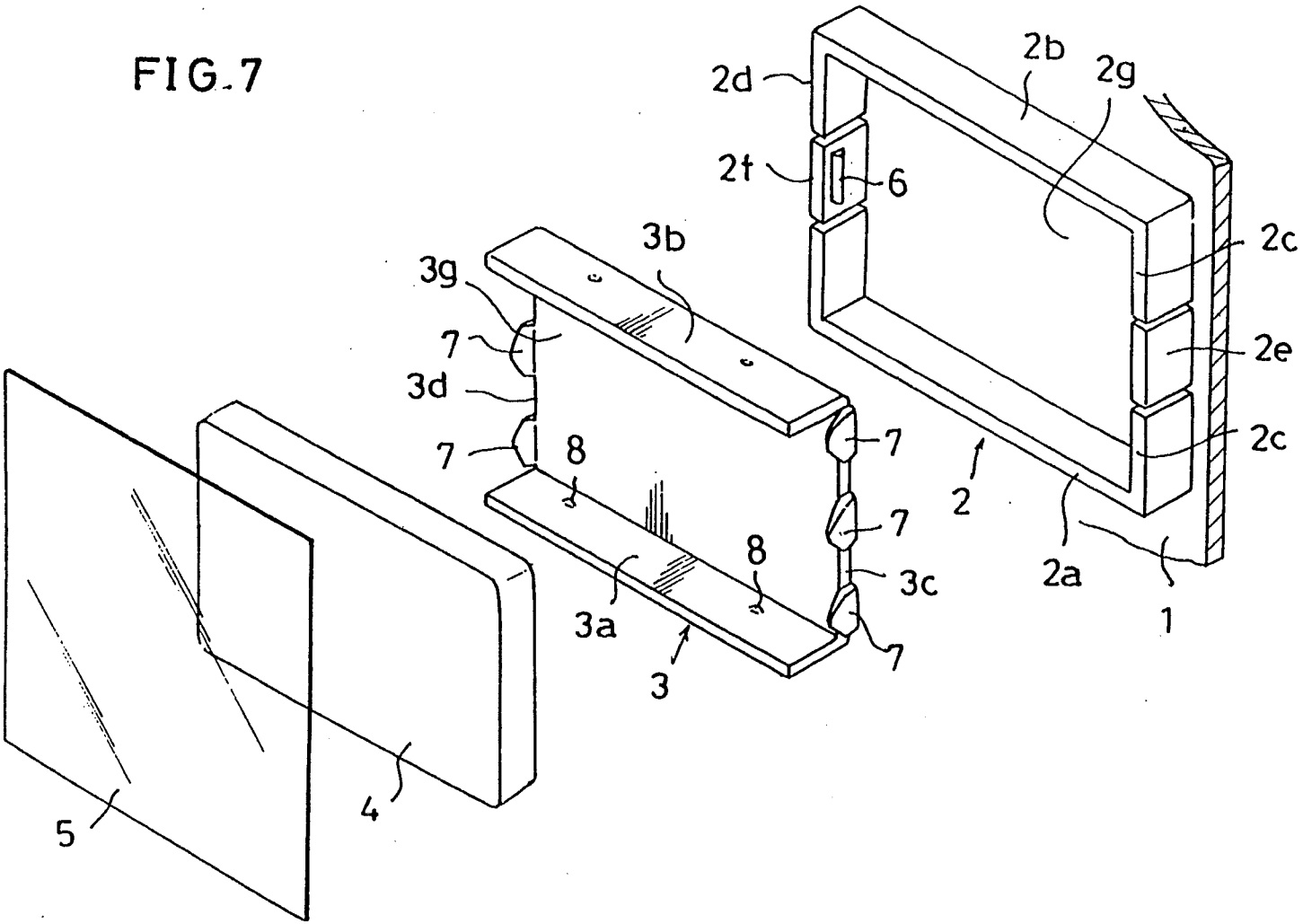
FIG. 7 is a developed perspective view showing the magnet holding structure.

This magnetic holding structure is designed to attach a plastic container (hereinafter some times referred to briefly as a basket) 1 to a steel structure by means of a permanent magnet 4 and comprises a mounting frame 2 and a magnet holder 3 as illustrated in FIG. 7.

As illustrated, the basket 1 is a plastic-mesh structure for holding a laundering load as molded with 3 units of said mounting frame 2 in strategical positions on its rear surface l*a* (FIG. 1).

The mounting frame 2 is rectangular in plan view and, as shown in FIGS. 2 and 7, comprises top and bottom side walls 2*a*, 2*b* and right and left side walls 2*c*, 2*d*, each of the latter side walls 2*c*, 2*d* being provided with slits to form a central side wall 2*e*, 2*f*. These central side walls 2*e*, 2*f* are isolated from the right and left side walls 2*c*, 2*d* by said slits and are resiliently deformable in the direction perpendicular to said top and bottom side walls 2*a*, 2 *b*. Furthermore, the inner surfaces of central side walls 2*e*, 2*f* are integrally formed with vertically extending pawls 6 as illustrated in FIGS. 3 and 7.

The magnet holder 3 is also rectangular in plan view and comprises top and bottom side walls 3*a*, 3*b* and three pairs of engaging projections 7. The magnet holder 3 is smaller than the mounting frame 2 on the whole but the engaging projections 7 and the pawls 6 are dimensioned so as to have an interference fit (FIG. 3).

Figure 4:
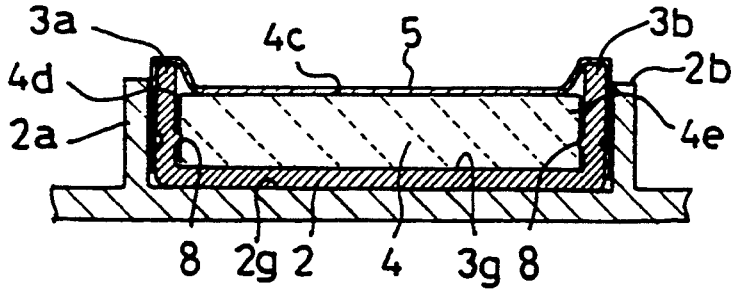
FIG. 4 is a longitudinal section view taken along the line IV—IV of FIG. 2.

The top and bottom side walls 3*a*, 3*b* are narrower than the top and bottom side walls 2*a*, 2*b* of said mounting frame 2 and are provided with four bulges 8 projecting from the inner surfaces thereof as formed by tapping the respective side walls 3*a*, 3*b* from the outer side toward the inner side (FIGS. 4 and 7).

Figure 3:
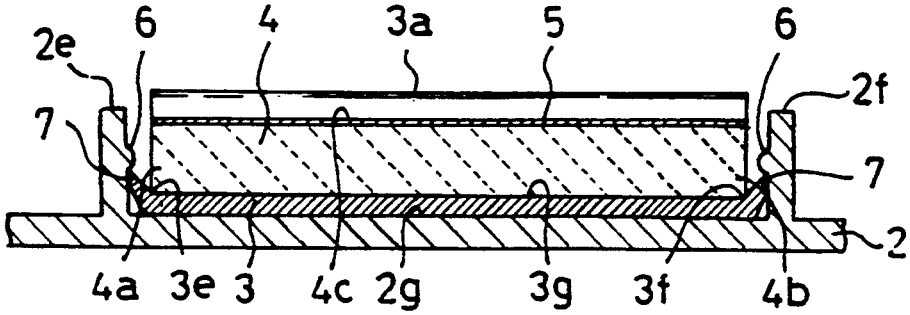
FIG. 3 is a transverse section view taken along the line III—III of FIG. 2.
Figure 5:
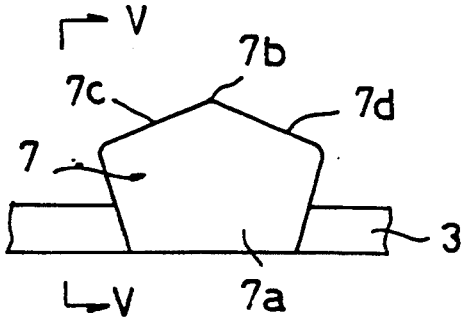
FIG. 5 is a side elevation view showing the engaging pawl.
Figure 6:
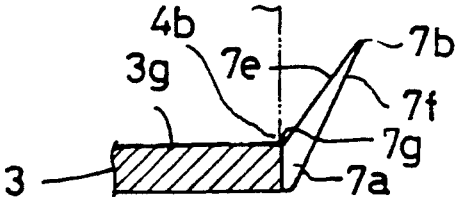
FIG. 6 is a longitudinal section view taken along the line V—V of FIG. 5.

Each engaging projection 7 is forwardly bent from a magnet holding surface 3*g* which is to be abutted against a permanent magnet 4 as shown in FIGS. 3 and 7. Moreover, as shown in FIG. 5, the right and left edges 7*c*, 7*d* of a forward central part 7*b* of each engaging projection 7 is inclined toward a base end 7*a* thereof. In addition, as shown in FIG. 6, a front surface 7*e* and a rear surface 7*f* of this engaging projection 7 are both planar, with the two planes 7*e*, 7*f* intersecting each other at the forward central part 7*b* mentioned above.

The bottom of the magnet holder 3 constitutes said magnet holding surface 3*g* and, as shown in FIG. 3, is limited by both sides 3*e*, 3*f* to form a generally concave surface. Therefore, when the permanent magnet 4 having a low profile (smaller in thickness) compared with the elevation of the top and bottom side walls 3*a*, 3*b*, right and left edges 4*a*, 4*b* of this magnet 4 are set in position by an inner base end 7*g* of the engaging projection 7 (FIG. 6), with the result that the lateral slide of the magnet 4 is precluded.

A protective film 5 is used to cover a top surface 4*c* of the magnet 4 so that the magnet 4 installed will not come into direct contact with the mounting surface.

The method of assembling the magnet holding structure described above and attaching a basket having the structure to a laundering machine is now described.

First, the permanent magnet 4 is set in the magnet holder 3. Thus, as the magnet 4 is pushed into the magnet holder 3 as illustrated in FIG. 7, it forces its way into the holder 3 as the top and bottom end surfaces 4*d*, 4*e* of the magnet 4 slide over the bulges 8 (FIG. 3). As the magnet 4 comes into intimate contact with the recessed magnet holding surface 3*g*, it is securely locked in the magnet holder 3. Then, the protective film 5 is applied to the magnet 4.

This magnet holder 3 is then set in the mounting frame 2. As the holder 3 is pushed into the frame 2, the right and left central side walls 2*e*, 2*f* of the frame 2 are expanded outward by the engaging projections 7 and the resultant resilient deformation facilitates insertion. Moreover, since the engaging projections 7 are forwardly bent from the magnet holding surface 3*g* and has an inclined rear surface 7*f*, this insertion work is further facilitated.

As the magnet holder 3 is abutted against the bottom 2*g* of the mounting frame 2, the central side walls 2*e*, 2*f* of the fame 2 restore their original shape so that the pawls 6 and the engaging projections 7 are securely engaged with each other. Since each of the engaging projections 7 has a pointed central end 7*b*, these projections tend to sink into the right and left side walls 2*c*, 2*d* to thereby prevent the magnet holder 3 against spontaneous detachment from the mounting frame 2.

Furthermore, since each engaging projection 7 is forwardly bent as described above, the lateral movement of the magnet holder 3 in the mounting frame 2 is restricted so that dislocation of the magnet holder 3 is precluded.

After the above assembling procedure, the container having the magnet holding structure is mounted on a lateral side 10*a* of the laundering machine 10 with the magnet side of the structure closer to the machine surface 10*a*, whereby the container, viz. basket 1, is secured to said surface 10*a* in semi-stationary state. Since the top surface 4*c* of the magnet 4 held by the magnet holder 3 is now disposed deeper than the top and bottom side walls 3*a*, 3*b*, the magnet 4 does not directly contact the lateral surface 10*a* of the laundering machine 10. Moreover, the magnet 4 is covered with the protective film 5 as mentioned previously. Therefore, the surface of the laundering machine 10 is protected from injury. When the basket is attached to the laundering machine, it may happen that the magnet is splashed with water. However, as the magnet 4 is protected as mentioned above, its force of attraction is not affected so that the basket 1 can be maintained stably in position.

When the magnet holding structure of the invention is applied to a utility case 9, the case 9 can be attached to a side surface 11a of a desk 11, for instance. In this application, too, the utility case 9 can be stably held in position.

By pulling said basket 1 or utility case 9 with force, it can be detached, together with the magnet 4, from the laundering machine 10 or desk 11. Then, by pulling the central side walls 2*e*, 2*f* of the mounting frame 2 apart with force, the magnet holder 3 can be easily slipped out from the mounting frame 2. Then, the magnet 4 can be taken out from the magnet holder 3.

Figure 8:
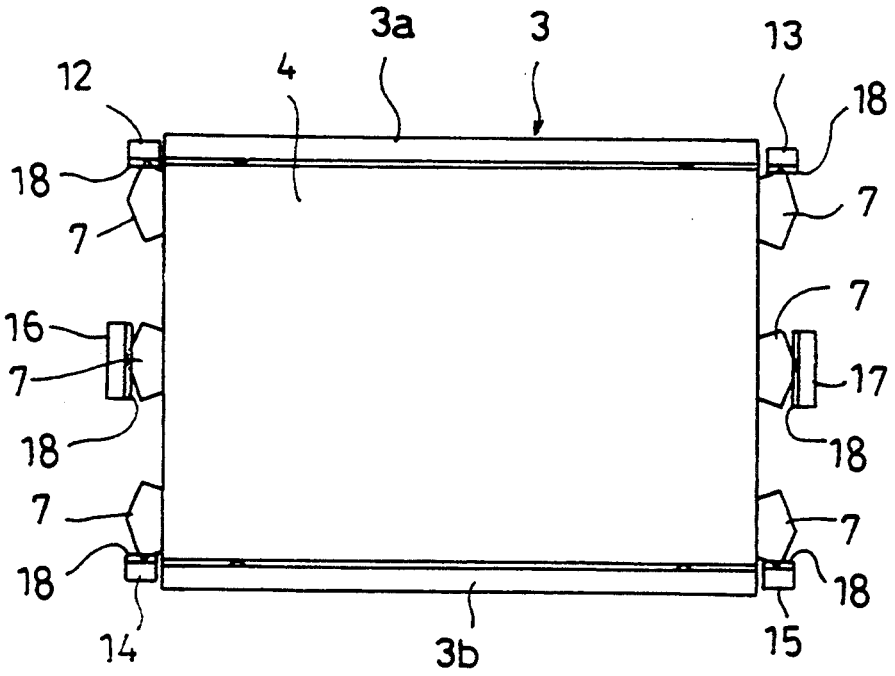
FIG. 8 is a plan view showing a magnet holding structure as another embodiment of the invention.

FIG. 8 is a plan view showing a magnet holding structure as another embodiment of the invention.

The basic construction of this magnet holding structure is similar to that of the embodiment described above. However, this structure is different from the latter in the constitution of the mounting frame 2. Therefore, the other components and parts will not be described in any further detail.

The mounting frame 2 of this embodiment comprises discontinuous projecting walls 12 through 17, with two pairs of walls 12, 13 and 14, 15 disposed on right and left sides and a pair of walls 16, 17 disposed in the center. The opposed surfaces of the left projecting walls 12, 14, of the right projecting walls 13, 15, and of the central projecting walls 16, 17 are respectively formed with an integral engaging pawl 18.

Figure 9:
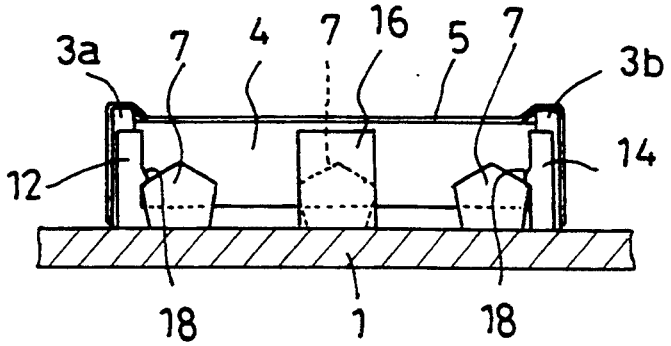
FIG. 9 is a side elevation view showing a magnet holding structure as still another embodiment of the invention.
Figure 10:
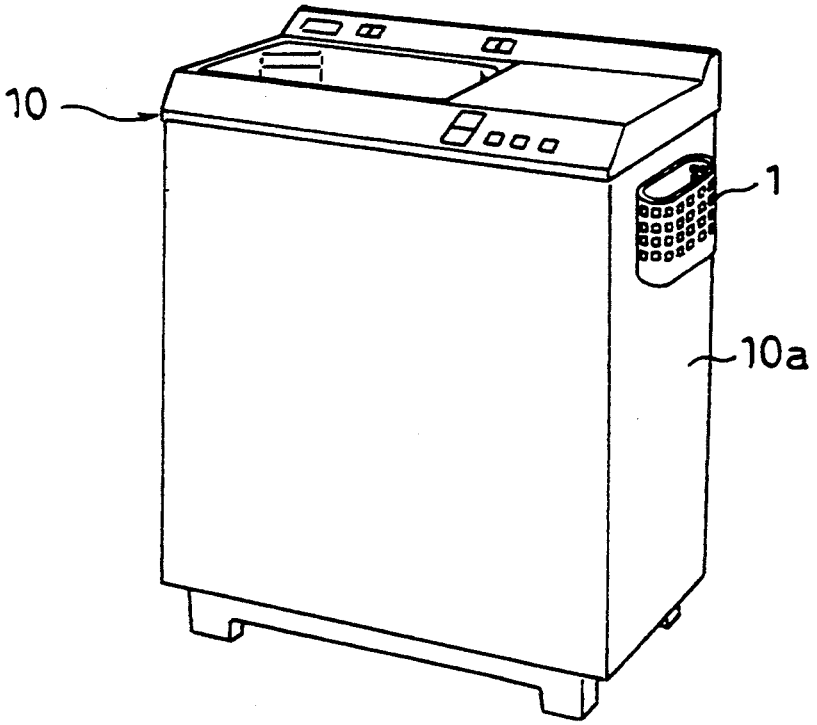
FIG. 10 is a perspective view showing a plastic basket attached to a laundering machine.
Figure 11:
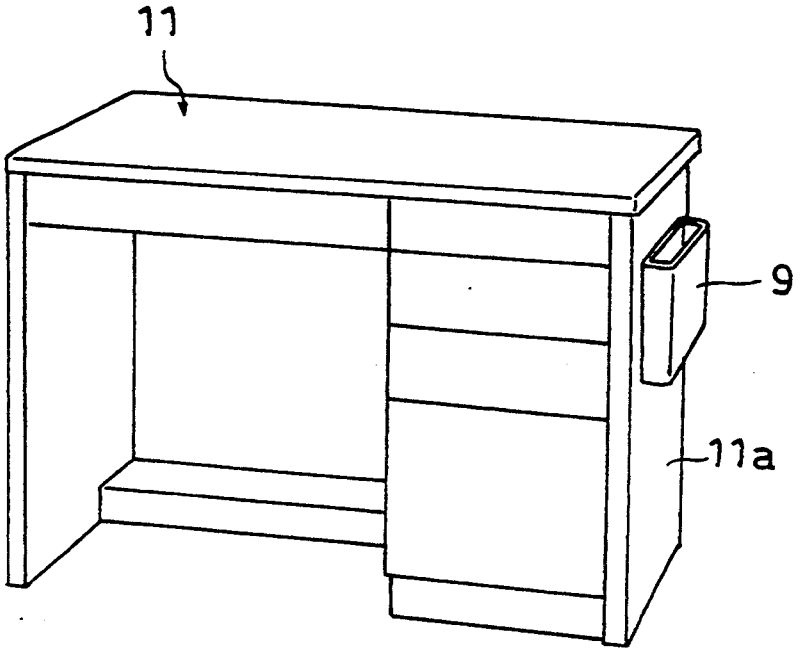
FIG. 11 is perspective view showing a utility case attached to a desk.

In this arrangement, the six projecting walls 12 through 17 is independently deformable to facilitate the mounting and dismounting of the magnet holder 3. Moreover, in the state where the magnet holder 3 is fitted by force against the projecting walls 12 through 17, the forward end or side of each engaging projection 7 is engaged by the engaging pawl 18 as shown in FIGS. 9, with the result that the holder 3 is securely protected against detachment.

Thus, in accordance with the present invention, a mounting frame is integrally formed with a container such as a plastic basket and as a magnet holder containing a permanent magnet is forced into this mounting frame, the holder is securely locked in the frame. And the container thus equipped with the magnet is attached to a steel surface with its magnet side closer to the surface by utilizing the force of attraction of the magnet, the container can be removably attached to the surface. This arrangement simplifies the procedure of attaching the container to a surface and detaching it as compared with the conventional procedure involving the use of a double-sided adhesive tape.

Moreover, even when this magnet holding structure is used in a highly humid environment, there is no risk of deterioration of the force of magnetic attraction and consequent spontaneous detachment of the container.

In addition, the structure can be easily disassembled into its component parts if necessary, so that the magnet and the plastic parts can be easily sorted out to contribute to recycling of wastes.

What is claimed is:

1. A magnet holding structure comprising a magnet holder means for holding a permanent magnet and a mounting frame means formed integrally with a container having a bottom wall portion and adapted to accept said magnet holder means, said mounting frame means including at least one pair of projecting walls and an engaging pawl on each inner surface of said projecting walls and spaced outwardly of said bottom wall portion and said magnet holder means having engaging projections corresponding to said engaging pawls, said projections being biased by their own innate resiliency against the inner surfaces of said projecting walls such that a portion of said projections engages a portion of said corresponding engaging pawls to prevent removal of said holder from said frame, and wherein said engaging projections of said magnet holder means are provided in a plurality of pairs, and further wherein said mounting frame means comprises a surrounding wall including top and bottom wall portions and left and right wall portions, said surrounding wall projecting from a container body, the inner surfaces of said right and left wall portions being integrally formed each with an engaging pawl and being capable of resilient deformation in the direction perpendicular to the top and bottom wall portions of said surrounding wall.

2. A magnet holding structure according to claim 1 wherein said surrounding wall is circumferentially discontinuous so that said portion having said engaging pawl is independent of the remainder of the wall.

3. A magnet holding structure according to claim 1 wherein each of said engaging projections is forwardly bent from a surface of said magnet holder means at which said engaging projections are abutted against the magnet.

4. A magnet holding structure according to claim 3 wherein each of said engaging projections has a front and a rear inclined planar surface with the respective planes intersecting each other at the terminal end of the engaging projection.

5. A magnet holding structure according to claim 4 wherein right and left side edges of said engaging projections are respectively inclined toward the base of the projection.

6. A magnet holding structure according to claim 1 wherein said magnet holder means has a concave magnet holding surface.

7. A magnetic holding structure according to claim 1 wherein said magnet held by said magnet holder means is covered with a protective film on top thereof.

* * * * *